US006585571B2

(12) United States Patent
Hyatt et al.

(10) Patent No.: US 6,585,571 B2
(45) Date of Patent: Jul. 1, 2003

(54) DISTAL END HONING DEVICE

(75) Inventors: Gregory Aaron Hyatt, West Chester, OH (US); David Wayne Bricker, Batavia, OH (US); Steven G. Hall, Cincinnati, OH (US)

(73) Assignee: Makino, Inc., Mason, OH (US)

( * ) Notice: Subject to any disclaimer, the term of this patent is extended or adjusted under 35 U.S.C. 154(b) by 33 days.

(21) Appl. No.: 09/827,312

(22) Filed: Apr. 5, 2001

(65) Prior Publication Data

US 2001/0034196 A1 Oct. 25, 2001

Related U.S. Application Data

(60) Provisional application No. 60/194,829, filed on Apr. 5, 2000, and provisional application No. 60/230,011, filed on Sep. 5, 2000.

(51) Int. Cl.[7] ..... B24B 5/04
(52) U.S. Cl. ..... 451/61; 451/504; 451/51
(58) Field of Search ..... 451/61, 504, 506, 451/465, 464, 466, 481, 27, 505, 155, 51

(56) References Cited

U.S. PATENT DOCUMENTS

| | | | | |
|---|---|---|---|---|
| 1,045,201 A | | 11/1912 | Shoop | |
| 1,444,314 A | | 2/1923 | Herder | |
| 1,951,998 A | | 3/1934 | Simonson | |
| 2,017,163 A | | 10/1935 | Reed | |
| 2,167,758 A | | 8/1939 | Johnson et al. | |
| 2,225,073 A | | 12/1940 | Miller | |
| 2,284,134 A | * | 5/1942 | Conner | 451/481 |
| 2,313,442 A | | 3/1943 | Kline | |
| 2,323,962 A | | 7/1943 | Ames | |
| 2,342,599 A | * | 2/1944 | Peterson et al. | 451/481 |
| 2,483,279 A | | 9/1949 | Hamilton | |
| 2,671,297 A | | 3/1954 | Arms | |
| 2,870,582 A | | 1/1959 | Raske | |
| 3,232,011 A | | 2/1966 | Pineau | |
| 3,362,113 A | | 1/1968 | Feather | |
| 3,380,197 A | * | 4/1968 | Fitzpatrick | 451/481 |
| 4,187,644 A | | 2/1980 | Fitzpatrick | |
| 4,209,951 A | | 7/1980 | Gillette | |
| 4,223,485 A | | 9/1980 | Largeteau | |
| 4,253,279 A | | 3/1981 | Althen | |
| 4,437,267 A | | 3/1984 | Corley | |
| 4,455,789 A | | 6/1984 | Gehring | |
| 4,471,576 A | | 9/1984 | Corley | |
| 4,524,549 A | | 6/1985 | Sunnen et al. | |
| 4,897,968 A | | 2/1990 | Hutt | |
| 5,022,196 A | | 6/1991 | Schimweg et al. | |
| 5,085,014 A | | 2/1992 | Sandhof | |
| 5,185,969 A | | 2/1993 | Vanderwal, Jr. | |
| 5,233,791 A | | 8/1993 | McQueen, Jr. | |
| 5,255,476 A | | 10/1993 | Rutter | |
| 5,351,447 A | | 10/1994 | Grauert | |
| 5,371,978 A | | 12/1994 | Higashikawa | |
| 5,800,252 A | * | 9/1998 | Hyatt | 451/505 |

FOREIGN PATENT DOCUMENTS

| | | | | |
|---|---|---|---|---|
| DE | 2913086 | * | 5/1980 | 451/466 |
| GB | 582075 | | 11/1946 | |
| JP | 55-144973 | * | 11/1980 | 451/464 |
| SU | 1425060 | * | 9/1988 | 451/481 |
| WO | WO 9218287 | | 10/1992 | |

* cited by examiner

*Primary Examiner*—Robert A. Rose
(74) *Attorney, Agent, or Firm*—Dinsmore & Shohl LLP

(57) ABSTRACT

Honing devices configured for use with a source of pressurized fluid. The honing device includes a honing body with a base extending along an longitudinal axis. The base may include a distal end and a proximal end adapted for fluid communication with a source of pressurized fluid. The honing body further includes a plurality of leaves with a first end attached to the distal end of the base and a second end spaced from the distal end. The outer surface of at least one of the plurality of leaves includes an abrasive work engaging surface. Pressurized fluid may encourage the second end of at least one of the plurality of leaves to move away from the longitudinal axis in order to hone the interior surface of the workpiece. Methods of honing the interior surface of a bore hole are also provided.

21 Claims, 4 Drawing Sheets

DISTAL END HONING DEVICE

CROSS-REFERENCES TO RELATED APPLICATIONS

This application claims benefit of U.S. Provisional Application No. 60/194,829 filed Apr. 5, 2000 and U.S. Provisional Application No. 60/230,011 filed Sep. 5, 2000.

TECHNICAL FIELD

This invention relates generally to honing devices and methods for machining of work pieces, and more particularly to a fluid-activated honing device for finishing work pieces wherein the effective machining diameter of the honing device is adjustable in response to fluid pressure.

BACKGROUND OF THE INVENTION

It is common practice in the machine tool industry to use honing devices for finishing the walls (e.g., removing about 0.001 to 0.005 inches of material) of a previously provided bore hole or similar interior surfaces of a workpiece. Honing operations generally correct inaccuracies in straightness and roundness in bore holes, can provide a generally uniform plateau surface in bore holes, can remove burrs or finish surfaces knurled, or can also provide a desired cross-hatch angle in the finish of the interior machined areas of a workpiece.

In the past, honing devices have generally been constructed with a plurality of symmetrically arranged work engaging assemblies having abrasives (e.g., rigid stones), which are mounted in slots on a device body for movement radially outwardly. Mechanical activation assemblies, such as springs, pusher rods, rack and pinion arrangements, tapers or cam devices, urge the work engaging assemblies, and advance the abrasives to a working position for engagement with a work surface. Also, these assemblies can assist in retracting the work surfaces from the working positions so that the honing device can be more easily removed from the interior of a workpiece. The nature of these assemblies for advancing the abrasives requires frictional engagement between the activation assembly and work engaging assembly, and thus, mechanical friction is generated at the interface. Over time, mechanical friction being continuously and repeatedly generated at this interface alters the interworkings of these mechanical assemblies due to use (e.g., wear and tear), and thus, compromises the accuracy of the device. Chips from the workpiece can also become lodged in the slots where the work engaging assemblies move radially outwardly from the device, and can even become lodged between the interface of the activation assembly and the work engaging assembly while the work engaging assemblies are radially moved outwardly to their working position, thereby interfering with the operations of the device. Such interference with the operations of the device can inhibit uniform radial expansion of the abrasive, which can also compromise and diminish the honing accuracy, and can cause excessive wear and tear on portions of the abrasive as a result of the work load being unevenly distributed. Moreover, the work engaging assemblies can even become fixed in the working position making removal of the honing device from the workpiece more difficult.

Some prior honing devices, such as illustrated U.S. Pat. No. 2,284,134 to Conner, mount a plurality of stone disposed in slots in an abrading head such that a balanced pressure urges the stones to move radially into a working position. Pistons or other fluid-activated means are used to move the stones outwardly. Since the device contemplates that the stones move away from the slots, recently cut chips can become lodged where the stones are moved radially from the abrading head to their working positions, and thus, can interfere with the operations of the device.

Another prior honing device, such as illustrated in U.S. Pat. No. 5,800,252 to Hyatt, mounts an essentially uninterrupted honing sleeve on a device mandrel. Pressurized fluid applied to the interior surface of the honing member deforms (e.g., activates) the honing sleeve in an axisemetric configuration. Since the honing sleeve is uninterrupted, the greatest range of deformation occurs adjacent the center portion of the device, making honing the inner most portion of a blind hole more difficult.

Other prior honing devices have used a sleeve-shaped configuration with one or more grooves or openings extending through the sleeve. The grooves or openings serve several important and necessary functions in the operation of these honing devices. First, they can provide a key way for guiding the mechanical activation assemblies, as discussed above, so that the activation assembly remains properly aligned as it advances in the desired direction. Secondly, the slots, in conjunction with a key on a device mandrel, can provide a key and groove arrangement for preventing rotation of the sleeve relative to the device mandrel during use.

Other previously available honing devices use suitable fluid pressure as the activation assembly for expanding flaps provided in an outer surface of a cylinder. For example, in U.S. Pat. No. 3,362,113 to Feather, a piece of emery cloth or other flexible abrasive material is wrapped around and secured to a cylinder, and, as the fluid pressure increases in a rubber tube disposed in the cylinder, the fluid pressure expands the flaps, thus, increasing the force between the abrasive surface and the inside surface of a bore hole. If fluid pressure is not properly controlled and rises above a critical level, the very nature of these assemblies allows for continued expansion of the sleeve as the workpiece is worked. Since the ability to control radial expansion of the device is hampered, device accuracy is compromised, and predicting or controlling the radial expansion corresponding to fluid pressure can be difficult and cumbersome.

Another honing device, for example as seen in U.S. Pat. No. 5,085,014 to Sandhoff, has honing rings mounted along the axial surface of a device body in annular grooves, and includes an abrasive layer on the outer periphery. An inner bore is provided within the device body that is adapted to supply coolant from a source to the interior surface of the honing rings for moving the rings into engagement with the bore surface. However, the rings do not uniformly expand in the radial direction. Instead, the rings expand as though uncoiling, whereby certain portions often expand further in the radial direction than other portions, such as those portions where the rings are secured to the device body. The resulting, non-uniform expansion of the device wears much more on certain areas of the abrasive (i.e., where radial expansion is greater) than on other areas. As devices are repeatedly used, accuracy and reliability of the honing device is compromised and the abrasives must often be replaced prematurely.

In almost all machine device operations, including honing, the friction between the device and workpiece generates tremendous amounts of heat energy, which can reach temperatures of 2000° F. (1100° C.) and above. If left uncontrolled, such heat could severely damage (e.g., cracking or fracturing) the device, thus reducing its device life, making machine device operations more dangerous and expensive, and reducing the quality and precision of the workmanship. In addition, heat generated friction can discolor the workpiece, and can damage or remove temper or heat treatments. It is commonly known in the industry that coolant can be introduced to the machining area, such as by spraying, to reduce friction between the device and workpiece by maintaining a thin film of coolant fluid between the cutting device and the workpiece, and to help remove heat energy generated in machine device operations.

Although coolant fluid can be supplied to the honing area, it is often difficult to insure that such fluid actually makes its way to the interstices between the device and all of the workpiece surfaces being machined. Additionally, fluid tends to evaporate quickly due to the high temperatures involved in honing operations. Thus, larger volumes of coolant fluid must generally be continuously supplied to the honing area for the honing device to operate effectively. This need to keep a thin continuous film of coolant fluid between the honing device and wall of the bore hole becomes even more problematic in operations where coolant fluids cannot be introduced in close proximity to the honing areas while the honing device is engaged with the interior surface of the workpiece.

During use, the work engaging surface of the device can also become loaded with particles or recently cut chips from the interior surface of the workpiece, which in turn, reduces the accuracy and effectiveness of the device through deteriorating honing ability, and/or clogging of conventional coolant fluid supply openings. It is obviously preferred that the potential for this undesired loading of particles be reduced, and that any loaded particles be removed from the honing device as quickly as possible. Typically, nozzle arrangements, such as an external cleaning jet, are provided independent of the device, for injecting coolant fluid at increased velocities toward the work engaging surface and the work surfaces of the workpiece to wash away particles, to remove particles already loaded on the work surface, and to cool the honing device and the workpiece. As mentioned before, it is often very difficult to insure that the fluid sprayed in this way actually reaches the most critical areas of the device/workpiece interface.

Other attempts to deliver coolant fluid to the honing area have included air or other pneumatic carriers. As with externally applied liquid coolants, when pneumatic carriers are used, resulting turbulence can hinder the honing operations, and often fluid cannot infiltrate into the actual honing area. Previously, attempts to address these two requirements of cooling and cleaning the honing device and workpiece have tended to reduce the accuracy and utility of the device.

As can be seen, currently available honing devices have a number of shortcomings that can greatly reduce the accuracy of the devices, the device's life, and its ability to use these devices with automatic device changing systems. The current structures and assemblies provide a honing device having working surfaces that can continue to expand with continued use of the device, whereby control and predictability of the device's expansion is compromised. Moreover, the work engaging assemblies of these prior honing devices do not always move uniformly in a radial direction when activated. Non-uniform movement of the assemblies results in uneven application of the abrasive, and reduces the assembly's usable life. Furthermore, other prior honing devices have working surfaces that move radially outwardly from a slot. Chips from the workpiece can become lodged in these slots when the working surfaces have been moved to the working position, which can hamper the operations of the device. A need currently exists in the machinery industry for a honing device with a substantially rigid work engaging assembly having accurately controlled machining diameters so that the device cannot become oversized a result of excessive strokes of the devices, and the ability to uniformly and selectively expand in a radial direction. As such, control and predictability of expansion is maximized and device life is enhanced.

SUMMARY OF THE INVENTION

Accordingly, it is an object of the present invention to address and obviate problems and shortcomings of conventional honing devices.

It is a further object of the present invention to provide an improved performance honing device that has durability and an increased device life.

It is also an object of the present invention to provide a honing device that eliminates the need for external coolant fluid jets for cleaning or removing loaded particles from the device's grinding surface during use, and routes fluid in close proximity to the work engaging surface to wash away recently cut particles.

It is yet another object of the present invention to provide an improved performance honing device where the workload is reliably distributed over substantially the entire work engaging surface.

It is another object of the present invention to provide an improved performance honing device for accurately and uniformly honing a workpiece.

It is further an object of the present invention to provide an improved performance honing device that can be selectively adjusted during machine operations for multi-stroke applications.

It is another object of the present invention to provide an improved honing device for use in providing desired range of cross-hatch angles in the working surfaces of a workpiece.

It is still another object of the present invention to provide an improved performance honing device in which coolant fluid delivery to the working area is not inhibited while the honing device is engaged with a surface of the workpiece.

It is an object of the present invention to provide an improved performance honing device that is easy to remove from a device mandrel.

It is yet an object of the present invention to provide an improved performance honing device that can be used with a quick change or automatic changeable device system having a fluid pressure source.

It is a further object of the present invention to provide an improved performance honing device that continuously, selectively, and controllably delivers coolant fluid to the machining area despite the type of device engagement.

Yet another object of the present invention is to provide an improved performance honing device which self regulates itself for wear and tear on the abrasive.

Still a further object of the present invention is to provide an improved performance honing device where the work engaging surface can be uniformly varied in a radial direction by selectively applying fluid pressure.

A further object of the present invention is to provide an improved performance honing device that dissipates thermal energy generated in the machining operations, and reduces thermal expansion of the honing member.

Another object of the present invention is to provide an improved performance honing device and method for honing a blind hole.

To achieve the foregoing and other objects in accordance with the present invention, honing devices are provided. The honing device includes a honing body with a base extending along a longitudinal axis. The base comprises a distal end and a proximal end adapted for fluid communication with a source of pressurized fluid. The honing body further comprises a plurality of leaves including an outer surface, an inner surface, a first end attached to the distal end of the base and a second end spaced from the distal end. The outer surface of at least one of the plurality of leaves includes an abrasive work engaging surface. The second end of at least one of the plurality of leaves is adapted to move away from the longitudinal axis in response to pressurized fluid from a source of pressurized fluid.

Still other advantages and objects of the present invention will become apparent to those skilled in the art from the following description wherein there are shown and described alternative exemplary embodiments of this invention. As will be realized, the invention is capable of other different, obvious aspects, objects and embodiments, all without departing from the scope of the invention. Accordingly, the drawings, objects and descriptions should be regarded as illustrative and exemplary in nature only, and not as restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF EXEMPLARY EMBODIMENTS

Figure 1:
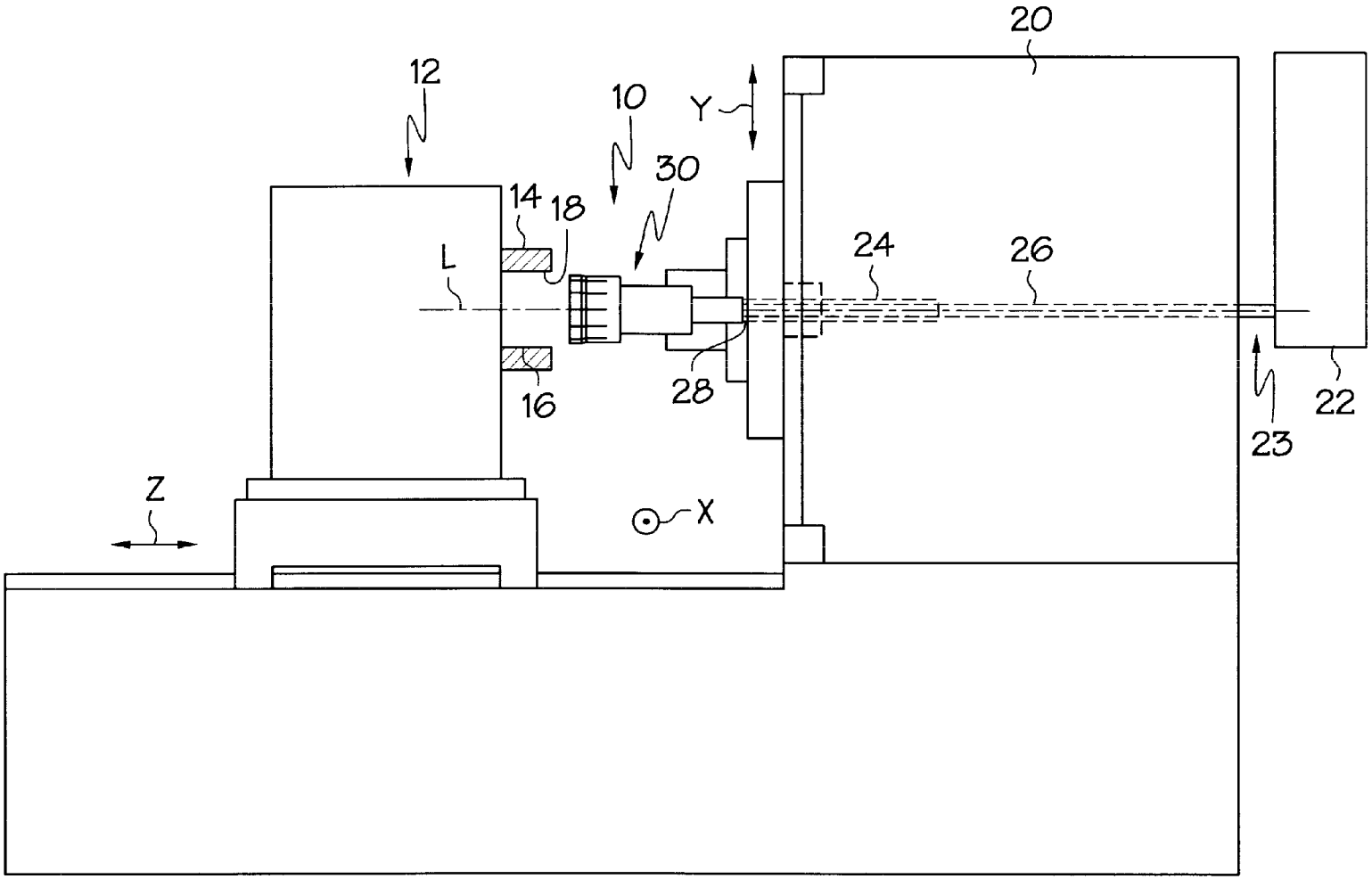
FIG. 1 is a schematic elevational view of a machine spindle showing fluid communication between a source of pressurized fluid and an exemplary honing device of the present invention arranged for quick change use in a machine center environment.

Referring now to the drawing figures in detail, where like numerals indicate the same elements throughout the views, FIG. 1 illustrates a working area 10 similar to the working area described in U.S. Pat. No. 5,800,252 to Hyatt issued on Sep. 1, 1998, the entire disclosure incorporated herein by reference.

The working area 10 in accordance to the present invention typically comprises a machine station 20 and a work head 12 having a workpiece 14 attached thereto using fixtures and techniques known in the industry. Workpiece 14 is illustrated as a single exemplary structure having a bore hole 16 with an interior surface 18 that requires honing or finishing. As illustrated in FIG. 1 of the present invention, the working area 10 is provided with an alternative embodiment of a device comprising a honing device 30 attached at a spindle/honing device interface 28 to a machine spindle 24. In operation, the honing device 30 and workpiece 14 are generally rotated respectively to each other about rotational axis (L) and may be moved respectively to each other along a horizontal axis (X), a vertical axis (Y) and/or horizontal axis (Z) as the honing device 30 is brought into contact with the workpiece 14 in order to enable machining operations such as honing.

The present invention is preferably adapted for use with a machining station or center 20 having a machine spindle 24 which can be rotated at varying speeds about rotational axis (L) by a power source (not shown), and which can quickly and easily receive and secure one of a plurality of devices and/or devices for various operations (i.e., rotating, vibrating, or oscillating). A machining station 20 typically has a synchronized system, such as an automatic device changer (not shown), for quickly and easily interchanging and utilizing multiple matching devices at one machining station or center 20, thereby allowing machining station 20 to provide greater utility or range of operations (i.e., they are not dedicated to a single operation or use of a single type of device).

Figure 3:
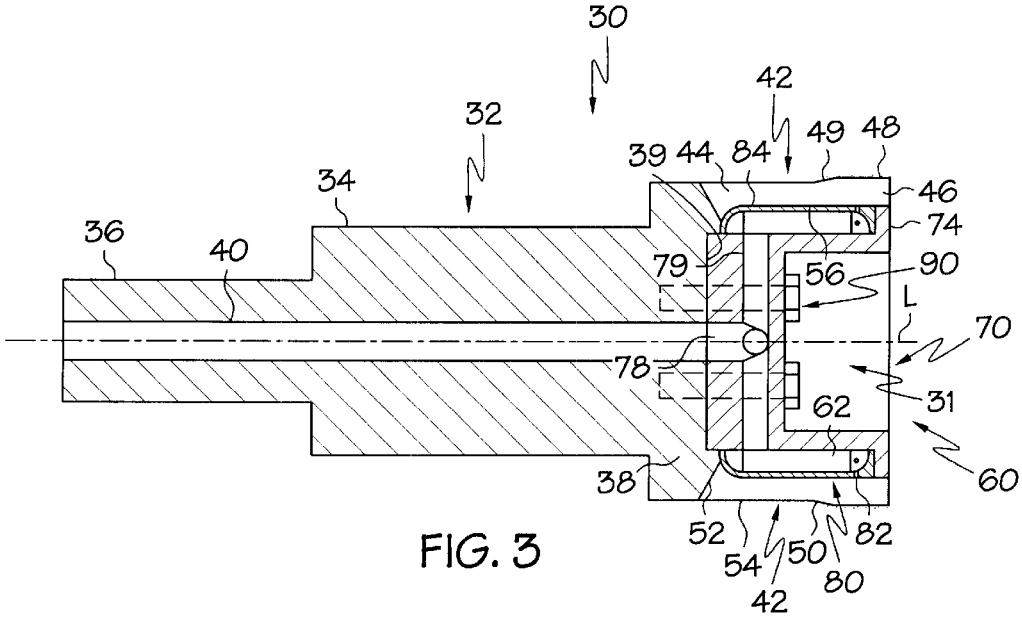
FIG. 3 is a vertical sectional view along line 3—3 of FIG. 2 illustrating details of the honing body and bladder apparatus of the present invention.

Any assembly for engaging (i.e., clamping or otherwise securing) a proximal end of the honing device 30 in a generally cantilevered fashion with a machine spindle 24, such as a drawbar, a collet, a mandrel device, or other device known in the industry, can be used, as long as fluid may be provided to the honing device 30 adjacent to the spindle device interface 28 while the honing device 30 is in use. For instance, U.S. Pat. No. 5,800,252 to Hyatt discloses an engaging assembly that may be used with the present invention that allows for quick interchange of devices and/or honing devices and provides fluid communication between the spindle passageway 26 and the fluid distribution pathway 40 of the base 34, as best shown in FIG. 3, without the need for separately hooking up hydraulic lines or other fluid connections. As will be understood, the honing device 30 could also be utilized in other conventional applications and operations.

Figure 2:
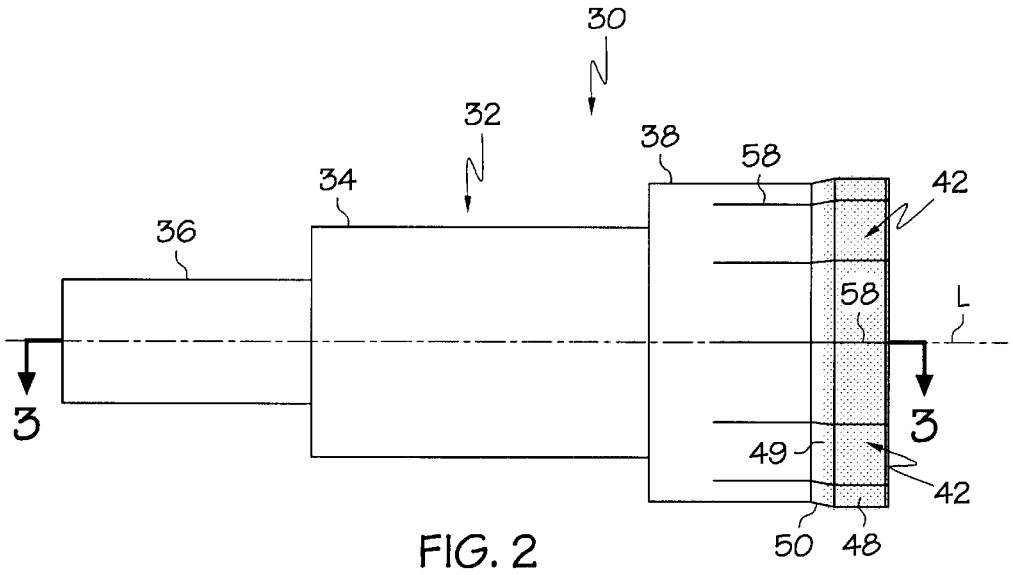
FIG. 2 is a side elevational view of an exemplary honing device made in accordance with the present invention.
Figure 4:
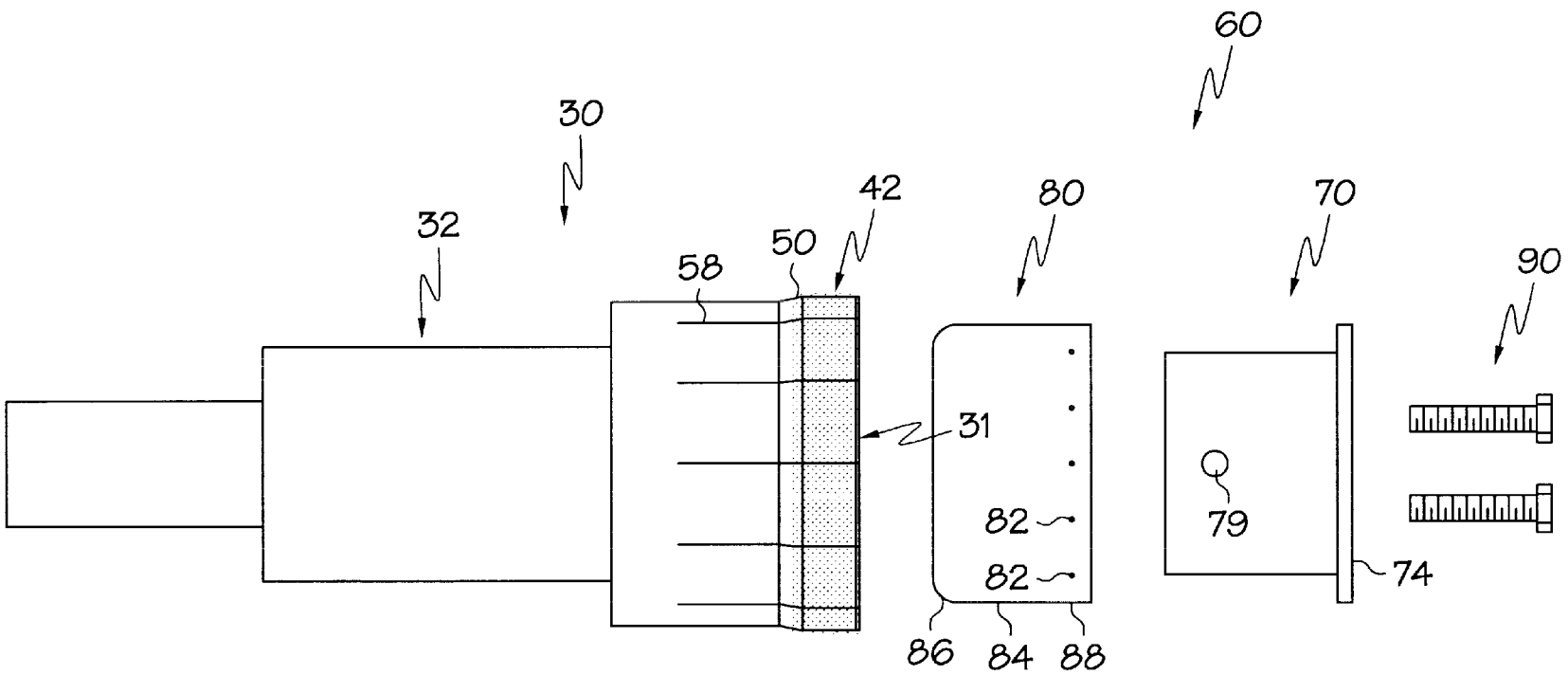
FIG. 4 is an exploded view of the honing device of FIG. 2.

Turning now to FIGS. 2–6, an exemplary embodiment of a honing device 30 is illustrated. The honing device 30 comprises a honing body 32 and a bladder apparatus 60 for use in combination. The honing body 32 comprises a base 34 extending along a longitudinal axis (L), and including a distal end 38 and the proximal end 36. The proximal end 36 is adapted for fluid communication with a source 22 of pressurized fluid. The honing body 32 further comprises a plurality of leaves 42 including an outer surface 54, an inner surface 56, a first end 44 attached to the distal end 38 of the base 34 and a second end 46 spaced from the distal end 38. In one embodiment, the leaves 42 are formed as cantilever leaves that are rigidly attached at the first end 44 to the distal end 38 of the base 34. As best shown in FIGS. 2–4 for example, the second end 46 of the leaves 42 are each free-standing in that no additional element is attached to the second ends 46 to limit expansion of the work surface 48. Although not shown, it will be understood that two or more of the second ends could be connected together (e.g., with a resilient band) to further limit expansion of the work surface 48.

The outer surface 54 of at least one of the plurality of leaves 42 includes an abrasive work-engaging surface 48. For example, the work surface may be made abrasive by knurling or otherwise or otherwise treating a work surface such that it has abrasive properties or by applying material such as an abrasive coating on the outer surface of the corresponding leaves 42. For instance, one or more layers of wear-resistant abrasives may be applied to, embedded in, formed on or plated on a portion of the outer surface of the leaves 42. Exemplary abrasives for use on the outer surface of the honing device may include those that are capable of providing a uniform plateau texture over the entire surface. In other applications, the abrasives used with the present invention may provide cross-hatch angles to base finish the bore hole 16 whereby the interior surface 18 has a certain degree of roughness to ensure a stable lubricating film in the bore hole, yet also allows for favorable sliding behavior of an element within the bore hole.

Illustrative examples of materials which might be used as abrasives include natural diamonds, synthetic materials including polycrystalline diamonds (PCD), manocrystalline diamonds (MCD), cubic borin nitride (CBN), or combinations of these materials. These types of abrasives may be used to hone materials such as gray cast iron. In an alternative embodiment, thin sheets such as emery cloth may be placed on or around the outer surface of the leaves 42.

As shown throughout the figures, each of the leaves 42 may have a greater thickness at the second end 46 than at the first end 44. In one particular example, a relief portion 50 such as an angled surface may provide a gradual or abrupt transition between the second end 46 and the first end 44. An abrasive work surface 48 as described above may be provided along the entire outer surface of the second end 46 and at least a portion of the relief portion 50 and may further extend to the outer surface 54 of the first end 44. Extending the abrasive material at least to the relief portion 50 prevents the interior surface 18 of the workpiece 14 from contacting the boundary 49 of the abrasive work surface 48 since the boundary 49 will occur somewhere along the reduced thickness of the leaves 42. Preventing contact between the interior surface 18 and the boundary 49 may be desirable in order to prevent irregularity in the honing surface.

As shown in FIG. 3, the first end 44 of each of the leaves 42 may have an angled portion 52 such that the length of the outer surface 54 is longer than the length of the inner surface 56. This exemplary arrangement tends to reduce the stresses due to the bending and/or pivoting of the leaves 42 relative to the base 34.

Each of the leaves 42 are separated by a slit or slot 58. For instance, a slit may be cut with a wire using Electrical Discharge Machining ("EDM") such that the slits are extremely narrow, in the order of ten-thousandths of an inch wide. A narrow slit is desirable to discourage the jacket 80 of the bladder apparatus 60 from entering the space between adjacent leaves 42.

The bladder apparatus 60 of the honing device 30 defines a bladder cavity 62. The bladder apparatus 60 may comprise a cap 70 and a jacket 80 disposed between the cap 70 and the plurality of leaves 42.

Figure 5:
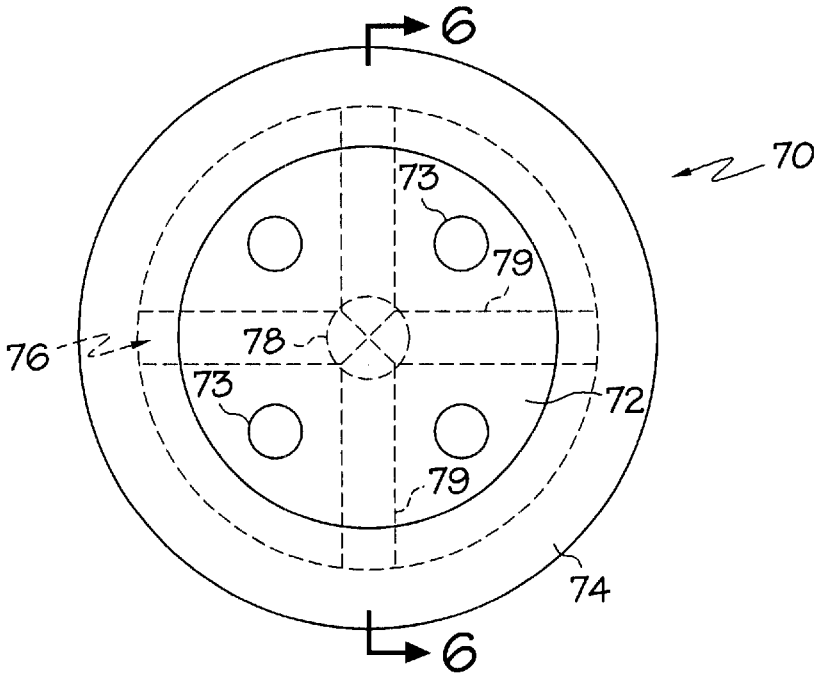
FIG. 5 is an end elevational view of a cap of the honing device illustrated in FIG. 3.
Figure 6:
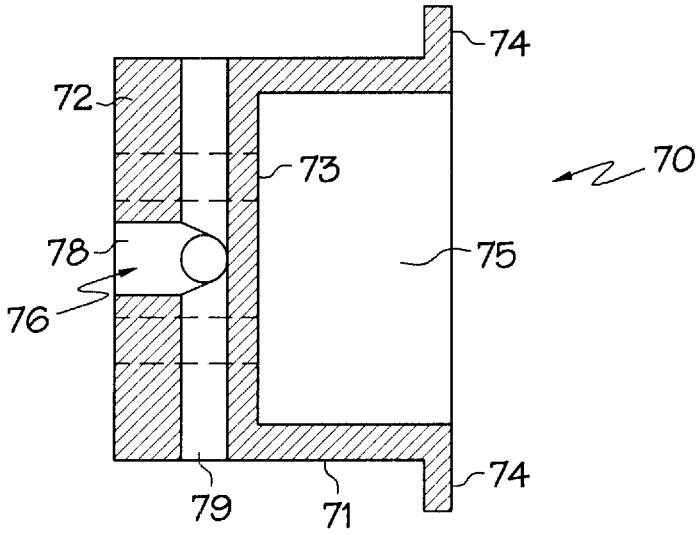
FIG. 6 is a vertical sectional view along line 6—6 of FIG. 5 illustrating the arrangement of the passage and flange of the cap.

As shown in FIGS. 5 and 6, the cap 70 comprises a base portion 72 defining a passage 76. In one embodiment, the passage 76 includes a first cap passage 78 in fluid communication with a second cap passage 79. A plurality of fastener bores 73 may be provided in order to accommodate fasteners therethrough. In one embodiment, the cap 70 comprises a raised sidewall 71 defining a hollow portion 75 in order to save material and reduce the mass of the honing device 30. The outer portion of the base portion 72 and/or the sidewall 71 may be provided with an outwardly extending flange 74.

As shown in FIGS. 3 and 4, the jacket 80 may be provided and located in between the cap 70 and the plurality of leaves 42. The jacket 80 may comprise an intermediate portion 84 for abutting against the inner surface 56 of the plurality of leaves 42. A proximal end 86 may be provided to lie adjacent to or abut against an outer surface of the cap 70 and might have a curved portion for abutting against the lower portion of the first end 44 of the leaves 42. A distal end 88 of the jacket 80 may further be provided in order to abut against a lower surface of the flange 74 as illustrated in FIG. 3 for example. Apertures 82 may be provided adjacent to distal end 88 and adapted to release pressurized fluid from the bladder cavity 62 of the bladder apparatus 60 in order to provide lubrication for the honing device and to remove machined material for example. In one exemplary embodiment, matching fixed apertures or replaceable nozzles may be provided in the leaves 42 of the honing device 30. The apertures or nozzles may be centered in the abrasive work-engaging surface 48 to ensure distribution of coolant fluid to the interstices between the leaves 42 and the workpiece 14. In still other examples, the jacket may be designed from a material that allows restricted flow of pressurized fluid. For instance, the jacket could be formed as a restrictive membrane. In still other examples, the jacket could be formed from a perforated material (such as a mesh) to restrict fluid flow through the jacket.

As shown in FIGS. 3 and 4, the honing device 30 is first assembled by inserting the bladder apparatus 60 at least partially into a portion of a cavity 31 defined by the plurality of leaves 42. For example, initially the jacket 80 may be inserted into the cavity 31 and then the cap may be inserted in the cavity 31 such that the jacket 80 is positioned between the plurality of leaves 42 and the cap 70. The cap 70 may then be connected with fasteners such as bolts 90 wherein the bolts 90 passed through fastener bores 73 which may be threaded or unthreaded and aligned threaded bores located in the distal end 38 of the base 34.

In one particular embodiment, as shown in FIG. 3, the distal end 38 of the base 34 may define a recess 39 adapted to at least partially receive the base portion 72 of the cap 70. Providing the distal end 38 of the base 34 with a recess 39 may assist in mounting of the jacket 80 with respect to the honing body 32 and the cap 70. In particular, providing jacket 80 with sufficient length will allow the jacket to be trapped and pinched between the flange 74 and the lower portion of the leaves 42 as the cap 70 is tightened by the fasteners 90 against the base 34, thereby allowing the jacket 80 to be pre-compressed in order to encourage the intermediate portion 84 of the jacket 80 against the interior surface 56 of the leaves 42 and/or to provide an increased fluid tight seal between the cap 70 and the jacket 80. Although not shown, another embodiment may use one or more optional sealing members, such as an o-ring. For example, a sealing member may be positioned between the jacket 80 and the base 34 and/or between the jacket 80 and the cap 70 to improve sealing of the cavity 62.

In order to facilitate operation of the honing device 30, the jacket 80 may comprise a relatively flexible material when compared with the cap 70. For instance, the cap 70 may be formed from a material having a higher modules of elasticity then the jacket 80. In order to facilitate operation of the honing device, the jacket 80 may have a significantly lower stiffness than the leaves 42. In one exemplary embodiment, the cap 70 may comprise rigid steel for instance while the jacket may comprise a nylon material such as DELRIN™ or polypropylene material. A variety of alternate polymers, metals, or composites in combination with appropriate wall thickness and jacket geometries can be used to achieve similar jacket/leaf stiffness ratios while maintaining good sealing characteristics.

The honing body 32 may be made of a rigid material (e.g., heat treated steel or the like) configured in a longitudinally extended generally cylindrical shape. A variety of standard materials available in the industry can be used to form the honing body 32, so that it is sufficiently rigid and maintains its structural integrity in the desired form during the honing operations at rotational speeds from about 200 to about 20,000 revolutions per minute. Examples of alternative materials that may be used include aluminum, steel or the like. In one example, an aluminum alloy might be used where there is a need for a lighter weight honing device 30, which might be desirable when the honing device 30 is interchangeable with a machine spindle 24 used in an automatic device changing system.

Once the bladder apparatus 60 is installed, a passageway 76 provides fluid communication between the passage 40 and the bladder cavity 62. In one embodiment, as shown in FIG. 3 for example, the passage 40 defined in the base 34 extends along the longitudinal axis (L) of symmetry of the base 34. A first cap passage 78 is also aligned along the longitudinal axis (L) and is in fluid communication with the passage 40. As shown in FIGS. 5 and 6, one or more second cap passages 79 may extend laterally from the first cap passage 78 in order to provide fluid communication between the passage 40 and the bladder cavity 62. As shown in the figures, the first cap passage 78 may have a larger diameter/dimension than the second cap passage 79 in order to feed sufficient fluid to the second cap passage(s) 79.

Preferably, the passage 40 defined in the base 34 of the honing body 32 extends along the longitudinal axis of symmetry (L) in the center which is the same center longitudinal axis of rotation of the honing device 30 when in use. Thus, the passage 40 is co-axial and has the same center axis of rotation of the honing device 30 in order to provide the device with symmetrical distribution of mass. As will be better understood from the description herein, this co-axial orientation of the honing body 32 and the passage 40 is preferred so that the interchanging of devices made in accordance here with (i.e., securing the honing device 30 in place and establishing fluid communication between the spindle passageway 26) can be accomplished quickly and automatically upon attachment of the honing device 30, and to preserve balance in the honing device 30 so that eccentricities, which could cause vibrations during use, are held to a minimum. In this regard, off-centering routing of supply passage (supply passages) 40 within the base 34 could be employed, but in such cases, it would be preferred to make such passages symmetrical with the base 34 to preserve balance during high speed device rotation.

As mentioned above, forming the honing device 30 with a passage 40 for fluid facilitates chip removal and reduces friction during the honing process and also provides an effective heat sink to dissipate thermal energy generated during machining operations, further minimizing undue thermal expansion and stresses. Undue thermal expansion, particularly in the radial direction, may undesirably change the outer diameter, and therefore affect the honing characteristics and dimensions of the honing device 30 in use.

Referring back to FIG. 1, the work area 10 also includes a fluid supply system 23 that generally feeds pressurized fluid from the supply 22, through the spindle 24, the base passage 40, the cap passage 76, and into the bladder cavity 62 of the bladder apparatus 60. The fluid supply system 23, often referred to as a through-spindle coolant or fluid system, also generally includes a compressor or other system (not shown) for pumping fluid at the desired pressure and flow rate. The spindle passageway 26 has a distal end which preferably automatically seals interfaces with the honing device 30 at the device/spindle interface 28. This seal might be provided in a variety of structural arrangements, including O-ring, seals and the like, and its exact structure may vary among particular applications.

Fluid communication is thereby automatically and immediately established and maintained between the spindle passageway 26 and the passage 40 when the honing device 30 is engaged and held in place by the engaging assembly such as engaging assembly discussed in U.S. Pat. No. 5,800,252 to Hyatt, using various assemblies and techniques known in the industry, as discussed previously. It should be noticed that when the honing device 30 is not engaged with the engaging assembly, mechanisms known in the industry (e.g., shut off valves or the like) can be used to terminate the flow of coolant fluid adjacent to the end of the spindle passageway 26. The passage 76 in the cap 70 is illustrated as splitting from a first cap passage 78 into a plurality of second branch cap passages 79 in order to establish fluid communication between the passage 40 and the bladder cavity 62 of the bladder apparatus 60. The second branch cap passage 79 may be appropriately oriented so that the honing device 30 remains balanced during use. As best shown in FIGS. 3, 5, and 6, second branch cap passages 79 may extend radially outward at an angle of about 90° relative to the longitudinal axis (L) of the base 34. The number of the passages 78, 79 may be sized and located to deliver an adequate volume of fluid through the honing body 32 to the bladder apparatus 60 or selectively extending the second ends 46 of each of the leaves 42 outwardly relative to the longitudinal axis (L). Some of the fluid in the bladder cavity 62 may be delivered or selectively leaked through apertures 82 defined in the jacket 80 for chip removal and to reduce friction and corresponding heat developed in the honing device 30 and the workpiece 14.

In use, fluid is directed under pressure from a fluid supply 22 with the fluid supply system 23 (e.g., from about 200 psi ($1.38\times10^6$ n/m$^2$) to about 250 psi ($1.72\times10^6$ n/m$^2$) and extending upwards to pressures in excess of about 1,000 psi ($6.89\times10^6$ n/m$^2$)). Exemplary liquids, such as any type of coolant/cutting fluids, are used with the present invention. For example, water-base coolants from about 5% to about 10% oils (i.e., lower oil content coolants) can be used. If fluid pressures reach 250 psi ($1.72\times10^6$ n/m$^2$) or above, emulsified oils can become unstable, and therefore, are not preferred. At high pressure, fluid oils are exemplary fluids utilized, since pure coolant fluid oils are known to provide a better finish on a work surface.

The pressurized fluid from the source 22 is fed through and/or by the fluid supply system 23 to the spindle passageway 26 and into the base passage 40. The pressurized fluid then activates the bladder apparatus 60 by first entering the first cap passage 78 from the base passage 40. The fluid then branches off into one or more second cap passages 79 and into the bladder cavity 62 defined between the jacket 80 and the cap 70.

Pressurizing the bladder cavity 62 causes at least the intermediate portion 84 of the jacket 80 to press up against the inner surfaces 56 of the leaves 42. Sufficient interior chamber pressure will cause the second ends 46 of the leaves to move away from the longitudinal axis (L), thereby increasing the effective outer dimension of the abrasive work surface 48. The outer diameter of the abrasive work surface 48 may be selectively adjusted by changing the fluid pressure supplied to the honing device 30. In addition, in certain exemplary applications the honing device 30 may be rotated at a sufficient speed to effect the outer diameter of the work surface due to the centrifugal force acting on the leaves 42. In further embodiments, the centrifugal force and fluid pressure may be used in combination to control the outer diameter of the work surface. For instance the centrifugal force and fluid pressure may each contribute to expanding the outer diameter of the work surface. In still other applications, one of the centrifugal force or fluid pressure balances out the other.

Various methods of using the honing devices may achieve the desired interior surface characteristics of the bore hole. One exemplary method includes the step of providing a fluid supply system 23 including a source 22 of pressurized fluid. A honing device 30 is further provided and rotated about a longitudinal axis. At least a portion of the honing device is inserted into the bore hole. The fluid pressure is altered in the fluid delivery system to modify the effective working diameter of the honing device. It will be understood that the order of the steps may altered depending upon the particular application. For instance, in one embodiment, the honing device is inserted into the bore hole prior to rotating the device. In another embodiment the fluid pressure is fluid pressure is undertaken while rotating the device. In further embodiments, the fluid pressure is altered while rotating the device. In certain embodiments, the effective working diameter of the honing device may be achieve substantially instantaneously in response to altering the fluid pressure. It will be understood that the present invention may also be used with a machine spindle 24 and a connector 28 wherein the honing device may be connected to the machine spindle with the connector to quickly and automatically provide fluid communication between the source of pressurized fluid and the honing device.

What is claimed is:

1. A honing device configured for use with a source of pressurized fluid, the honing device comprising:

a honing body including a base extending along a longitudinal axis, the base including a distal end and a proximal end adapted for fluid communication with a source of pressurized fluid, the honing body further comprising a plurality of leaves, each of the plurality of leaves including an outer surface, an inner surface, a first end attached to the distal end of the base and a second end spaced from the distal end, the outer surface of at least one of the plurality of leaves includes an abrasive work engaging surface, the plurality of leaves defining at least a portion of a cavity such that the inner surface of each of the leaves faces the cavity and the outer surface of each of the leaves faces away from the cavity, wherein the cavity is adapted to receive pressurized fluid from a source of pressurized fluid and wherein the second end of at least one of the plurality of leaves is adapted to move away from the longitudinal axis in response to pressurized fluid in the cavity.

2. The honing device of claim 1 wherein each of the plurality of leaves is formed as a cantilever leaf that is rigidly attached at the first end to the distal end of the base.

3. The honing device of claim 1, wherein the second end of each of the plurality of leaves is free-standing.

4. The honing device of claim 1, wherein the first end of each of the plurality of leaves is angled such that the outer surface of each of the plurality of leaves is longer than the inner surface of each of the plurality of leaves.

5. A method of honing the interior surface of a bore hole comprising the steps of:

a) providing a fluid supply system including a source of pressurized fluid;

b) providing a honing device comprising:

a honing body including a base extending along a longitudinal axis, the base including a distal end and a proximal end in fluid communication with the source of pressurized fluid, the honing body further comprising a plurality of leaves, each of the plurality of leaves including an outer surface, an inner surface, a first end attached to the distal end of the base and a second end spaced from the distal end, the outer surface of at least one of the plurality of leaves includes an abrasive work engaging surface, the plurality of leaves defining at least a portion of a cavity such that the inner surface of each of the leaves faces the cavity and the outer surface of each of the leaves faces away from the cavity, wherein the cavity is adapted to receive pressurized fluid from the source of pressurized fluid and wherein the second end of at least one of the plurality of leaves is adapted to move away from the longitudinal axis in response to pressurized fluid in the cavity to increase the effective working diameter of the honing device;

c) inserting at least a portion of the honing device into the bore hole;

d) rotating the device about the longitudinal axis; and e) selectively altering the fluid pressure in the fluid delivery system to alter the fluid pressure in the cavity for selectively modifying the effective working diameter of the honing device.

6. The honing device of claim 1, further comprising a bladder apparatus at least partially received by the cavity.

7. The honing device of claim 6, wherein a passage is defined in the base and extends from the proximal end to the distal end, the passage adapted to allow pressurized fluid to travel from the proximal end to the distal end to be received by the bladder apparatus.

8. The honing device of claim 6, wherein the bladder apparatus comprises a cap and a jacket, wherein the jacket is located between the cap and the plurality of leaves.

9. The honing device of claim 8, wherein the cap is attached to the distal end of the base.

10. The honing device of claim 9, wherein the cap is attached with fasteners to the distal end of the base.

11. The honing device of claim 8, wherein the cap includes a base portion attached to the distal end of the honing body, wherein the base portion extends away from the distal end and spaced from each of the plurality of leaves.

12. The honing device of claim 11, wherein the cap further includes a flange attached to the outer end of the base portion and extending towards the second ends of the plurality of leaves.

13. The honing device of claim 8, wherein the jacket includes at least one aperture adapted to release pressurized fluid from the bladder apparatus.

14. The honing device of claim 8, wherein the jacket comprises an intermediate portion abutting the inner surface of each of the plurality of leaves, and wherein a bladder cavity is defined between the jacket and the cap.

15. The honing device of claim 14, wherein a passage is defined in the base of the honing body and extends from the proximal end to the distal end, the passage adapted to allow pressurized fluid to travel from the proximal end to the distal end to be received by the bladder apparatus.

16. The honing device of claim 15, wherein a passage is defined in the cap, wherein the passage in the cap provides fluid communication between the passage in the base and the bladder cavity such that pressurized fluid may travel from a source of pressurized fluid, through the passage in the base, through the passage in the cap, and into the bladder cavity.

17. The honing device of claim 8, wherein the cap is formed from a material having a higher modulus of elasticity than the material forming the jacket.

18. The method of claim 5, wherein the at least a portion of the honing device is inserted into the bore hole prior to rotating of the device.

19. The method of claim 5, wherein the step of altering said fluid pressure is undertaken while rotating the device.

20. The method of claim 5, wherein the step of selectively altering the fluid pressure comprises increasing the fluid pressure substantially instantaneously to accomplish a relatively abrupt predetermined change in the effective working diameter of the honing device.

21. The method of claim 5 further comprising the steps of:

a) providing a machine spindle;

b) providing a connector; and c) connecting the honing device to the machine spindle with the connector to quickly and automatically provide fluid communication between the source of pressurized fluid and the honing device.

* * * * *